US006725580B2

(12) United States Patent
Eriksson et al.

(10) Patent No.: US 6,725,580 B2
(45) Date of Patent: Apr. 27, 2004

(54) WORKING DEVICE

(75) Inventors: Per Eriksson, Kyrkbyn 1, Transtrand (SE), S-780 68; Ulf Thoors, Malung (SE)

(73) Assignee: Per Eriksson, Transtrand (SE)

( * ) Notice: Subject to any disclaimer, the term of this patent is extended or adjusted under 35 U.S.C. 154(b) by 0 days.

(21) Appl. No.: 10/203,002

(22) PCT Filed: Feb. 5, 2001

(86) PCT No.: PCT/SE01/00206

§ 371 (c)(1),
(2), (4) Date: Nov. 18, 2002

(87) PCT Pub. No.: WO01/57321

PCT Pub. Date: Aug. 9, 2001

(65) Prior Publication Data

US 2003/0136030 A1 Jul. 24, 2003

(30) Foreign Application Priority Data

Feb. 3, 2000 (SE) ..... 0000347

(51) Int. Cl.[7] ..... E02F 3/96; E01H 5/00

(52) U.S. Cl. ..... 37/241; 37/403; 37/244; 37/222; 172/817; 172/247

(58) Field of Search ..... 37/241, 240, 242, 37/244, 248, 249, 253, 219, 221, 222, 224, 223, 403, 468; 172/817, 247, 253, 254; 414/723, 912

(56) References Cited

U.S. PATENT DOCUMENTS

| | | | | | |
|---|---|---|---|---|---|
| 2,724,915 | A | * | 11/1955 | Leduc | 37/232 |
| 3,230,645 | A | * | 1/1966 | Lutz | 37/242 |
| 3,774,321 | A | * | 11/1973 | David | 37/243 |
| 3,867,992 | A | * | 2/1975 | Waterman | 180/14.4 |
| 4,506,464 | A | * | 3/1985 | Cartner | 37/91 |
| 4,966,242 | A | * | 10/1990 | Baillargeon | 180/9.44 |
| 4,986,010 | A | * | 1/1991 | Cartner | 37/382 |
| 5,419,380 | A | * | 5/1995 | Bot | 144/334 |
| 5,490,755 | A | | 2/1996 | Billotte | |
| 5,659,984 | A | * | 8/1997 | Haug | 37/219 |
| 5,666,794 | A | * | 9/1997 | Vought et al. | 56/15.2 |
| 5,809,671 | A | * | 9/1998 | Sinykin | 37/219 |
| 5,940,995 | A | * | 8/1999 | Venhomaa | 37/240 |
| 5,970,634 | A | * | 10/1999 | Dann et al. | 37/301 |
| 6,026,600 | A | * | 2/2000 | Lela | 37/219 |
| 6,351,899 | B1 | * | 3/2002 | Slutzky | 37/223 |
| 6,367,176 | B1 | * | 4/2002 | Zaugg et al. | 37/240 |
| 6,481,123 | B1 | * | 11/2002 | Kanzler et al. | 37/223 |

FOREIGN PATENT DOCUMENTS

| | | |
|---|---|---|
| SE | 510 875 | 7/1999 |
| WO | WO 98/33986 | 8/1998 |

* cited by examiner

*Primary Examiner*—Victor Batson
(74) *Attorney, Agent, or Firm*—Young & Thompson

(57) ABSTRACT

A device (10) for performing work tasks within a work area, in particular a ski run area, includes a working unit (60, 90), a manoeuvring machine (12, 30, 32, 37) to which the working unit is arranged. The manoeuvring machine is designed and arranged such that it is capable of manoeuvring the working unit in at least three degrees of freedom. The device is designed as an individual unit intended to be detachably arranged to a work vehicle, such as a snow working unit.

19 Claims, 13 Drawing Sheets

WORKING DEVICE

TECHNICAL FIELD

The present invention relates to a device for performing different work tasks within a work area, in particular a ski run area, comprising a working unit, a manoeuvring means to which the working unit is attached, and that the manoeuvring means is intended to be arranged to a vehicle.

BACKGROUND OF THE INVENTION

For ski resorts, special vehicles are used in preparing the foundation for the ski runs and the cross-country trails. These special vehicles, so called snowgrooming vehicles, are track-driven in order to be able to manoeuvre. They are equipped with snow forming devices that are pulled behind for smoothing the surface. Further they are arranged with hydraulically manoeuvred ploughs in the front for transporting snow, such as to cut off bumps and fill deeper tracks and cavities.

During recent years the demands on a more varied skiing in the ski runs has increased, in particular with the arrival of snowboard and its utilisers, but also for ordinary skiing. For that the ski run areas have been designed with different "artificial" configurations, such as mogules, jumps and so called half-pipes. The latter is mainly U-shaped runs where the riders go up and down on the sides and perform different tricks and stunts. These designs demand relatively large amount of work to build up and maintain, for which the conventional snowgrooming vehicles are not optimally designed. In particular the build-up of high jumps and half-pipes where the height from its bottom to the edge can be several meters, require moving large amounts of snow up to heights that the conventional snowgrooming vehicles can not accomplish. Previously, this has required manual labour or the use of digging vehicles that are not adapted to be driven on snow.

One attempt to accomplish half-pipes and the like curved tracks is described in WO9833986, showing a snow vehicle on which a crane arm is attached, which partly is rotatable around a vertical axis and partly has a joint. At the end of the arm, a snow working unit is arranged, which comprises a rotating snow mill roll or mat. During use, the machine is driven along the longitudinal direction of the track and the snow working unit is moved along the curvature of the track for forming the same.

The device according to WO9833986 displays a number of drawbacks. Because the device is attached to the snow vehicle, the usage of the vehicle is limited, i e the vehicle becomes more or less a special vehicle for only preparing half-pipes and the like tracks and surfaces. In order to fully use the vehicle for other work tasks that are present at ski run areas, the device has to be dismantled, which is time-consuming.

A further drawback is that the device is mounted behind the driver's cab in the driving direction of the vehicle, which essentially decreases the preparation work of the driver in that the driver, after completing the preparation of a section of the track, has to turn around in order to drive to the next section, and then again turn backwards.

A further drawback is that the snow working unit that is disclosed in the description is not capable of transporting any larger amounts of snow, instead it is only capable of finely adjusting a previously coarsely formed track. This implies that the coarse-forming has to be performed by another machine or by hand in as conventional manner. With the working unit described, there are further large problems in directing and controlling the snow that has been worked away in that there are no means present for directing the snow, but rather it is thrown away more or less uncontrolled, which makes it difficult for the driver to direct the snow to parts that need to be built up. Further there is a great risk that the milled snow creates a "snow cloud" of fine particles, deteriorating the sight, whereby the drive has difficulties controlling the way the unit is steered.

As regards the design of half-pipes, demands are put, especially for competitions, regarding dimensions and the rounding of the walls as well as the surface of the foundation and durability. These demands have led to labour-intensive, and therefore costly, operations.

Apart from the above mentioned aspects, it shall be noted that a plurality of work tasks needs to be performed on a ski run area, such as general snow handling, control of ski lifts, whereby the workers need to reach certain heights, removal of grass and bushes during summer time, the laying of water pipes for snow guns, removal of trees and the like. A work area such as a ski run area thus has a need for a device, which in a flexible and simple way can fulfil these requirements without departing from functionality and without requiring several different work machines.

BRIEF DESCRIPTION OF THE INVENTION

The aim of the present invention is to provide a device for the performing of different work tasks that remedies the above problems, that preferably can be attached to and utilised by machines present in ski run areas, that is efficient and flexible and adapted to be used for many work tasks present in a ski run area during winter as well as summer.

This aim is obtained according to one aspect of the invention with a device according to patent claim 1.

Preferable embodiments of the invention are characterised by the dependent claims.

The device according to the invention comprises an arm rotatably arranged to a stand and that the arm is jointed. The arm is further also slidable in the longitudinal direction for altering the length of the arm. At the end of the arm, a number of different work tools can be attached, such as for example a thrower for removing and forming larger amounts of snow, a preparation device for fine preparation, shovel, work platform, bush cutter, gripping means, and other tools. The stand is designed as an individual unit that can be releasably attached to a vehicle.

This makes it very simple to attach and detach the device according to need, which provides a very flexible way of working and which for example provides for a snowgrooming vehicle, which is used in ski run areas for preparing the ski runs, to readily attach the device in order to perform machining and preparations of half-pipes and the like. Due to the design of the arm with its joint and the moving in and out of the outreach, advantages are obtained in that a very good control of the working unit can be achieved regarding the desired forms, radii and the like and in that the working area can be varied from very small protrusions to the really large half-pipes with wall heights of up to 6 meters.

The device according to the invention utilises according to one embodiment a snow thrower specially adapted for the working and forming of snow surfaces such as half-pipes. This comprises a rotor with teeth designed and arranged such that a very good working is obtained also on very hard packed snow and where the worked snow can be controlled partly for obtaining an even worked surface, partly for removing and placing of the snow to selected places and partly for avoiding the "snow cloud" that often tends to form during milling of the snow, whereby the driver has full visibility of the working unit.

According to a further aspect of the invention, it is characterised by a snow working unit comprising a milling device for the grinding of the snow surface and packing part following in the work direction of the snow working unit comprising a substantially planar surface.

The advantages with the device according to the present invention are several. Because the working unit is maneouvrable in at least three degrees of freedom, a very flexible device is obtained with a large work area. Due to the jointed arm arrangement movable along three coordinate axes, complex forms, such as for example the sides of a half-pipe, can be created in a labour saving and at the same time exact way. When further the snow working unit is jointly, and also rotatably, arranged to the device, a very exact steering is obtained for optimal result.

Because the direction of the worked snow, and thrown from the snow working unit, can be controlled to the desired location, a labour-saving way of handling the snow is obtained rather than if it is thrown away in arbitrary directions.

With the preferred snow working unit, a very even but yet durable surface is obtained in that the milling unit due to the "roughing" of the surface firstly ensures that cold air penetrates the snow surface, whereby the thickness of the harder surface layer increases. The subsequent vibrating packing provides an even higher hardness and wear-resistance to the harder surface layer. The final adjustment then provides an even running surface.

These and other aspects of, and advantages with, the present invention will become apparent from the following detailed description of some embodiments of the present invention and from the accompanying drawings.

BRIEF DESCRIPTION OF THE DRAWINGS

In the following detailed description of the invention, reference will be made to the drawings, of which

DETAILED DESCRIPTION OF THE INVENTION

Figure 1:
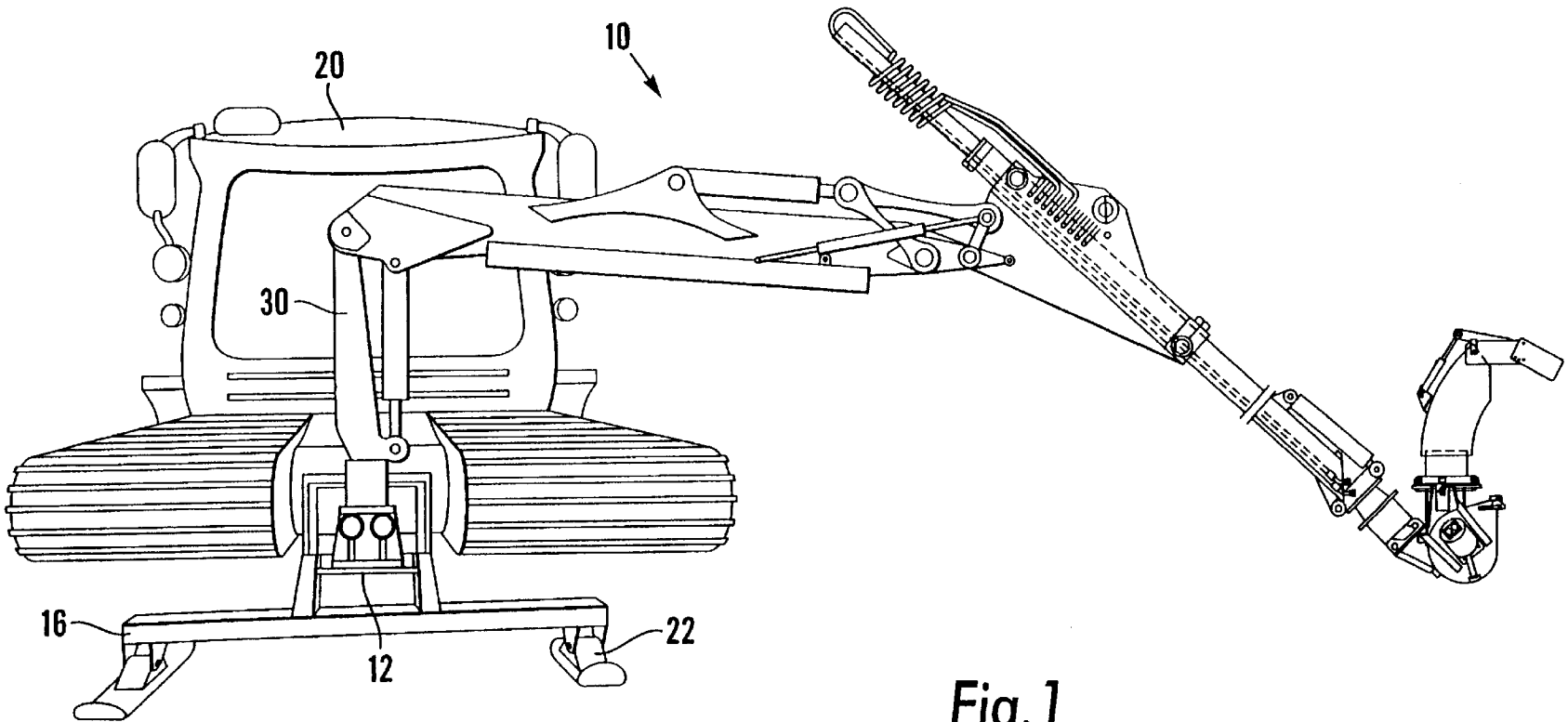
FIG. 1 shows a plan view of a device according to the present invention attached to a snowgrooming vehicle, FIGS. 2*a, b* show a side view of the device according to claim 1.

The device for performing work tasks that is shown in the drawings has generally a reference numeral 10. As is shown in the FIGS. 1–4 the device comprises a stand 12. The stand is designed as a frame 14 with a front carrier beam 16. The rear part of the stand is arranged with an attachment 18, FIG. 2*a*, for attachment to the tool attachment of a vehicle. In the embodiment shown, the attachment is designed as a so called Volvo BM- attachment, which many machine manufacturers utilise, for easy and simple attachment of the device to a vehicle. It shall of course be understood that other attachments present on the market also can be used. In this respect, the attachments can preferably be releasably designed, so called adapters, whereby the manufacturing of the device is facilitated in that a standard attachment is used, on which the desired attachment is mounted. In FIG. 1 the tool attachment is placed in the front of a snowgrooming vehicle 20. In this context it shall be understood that other machines, such as wheel loaders, can attach the device according to the invention to its tool attachment, if certain work tasks shall be performed that do not require a snowgrooming vehicle. The frame is further arranged with a mounting plate 19.

Hydraulic attachments (not shown) are arranged between the hydraulic system of the vehicle and the stand 12 via quick couplings. It is hereby conceivable to use a system, which connects the hydraulic conduits automatically when the device is attached to the tool attachment of a vehicle.

Figures 2A, 2B:
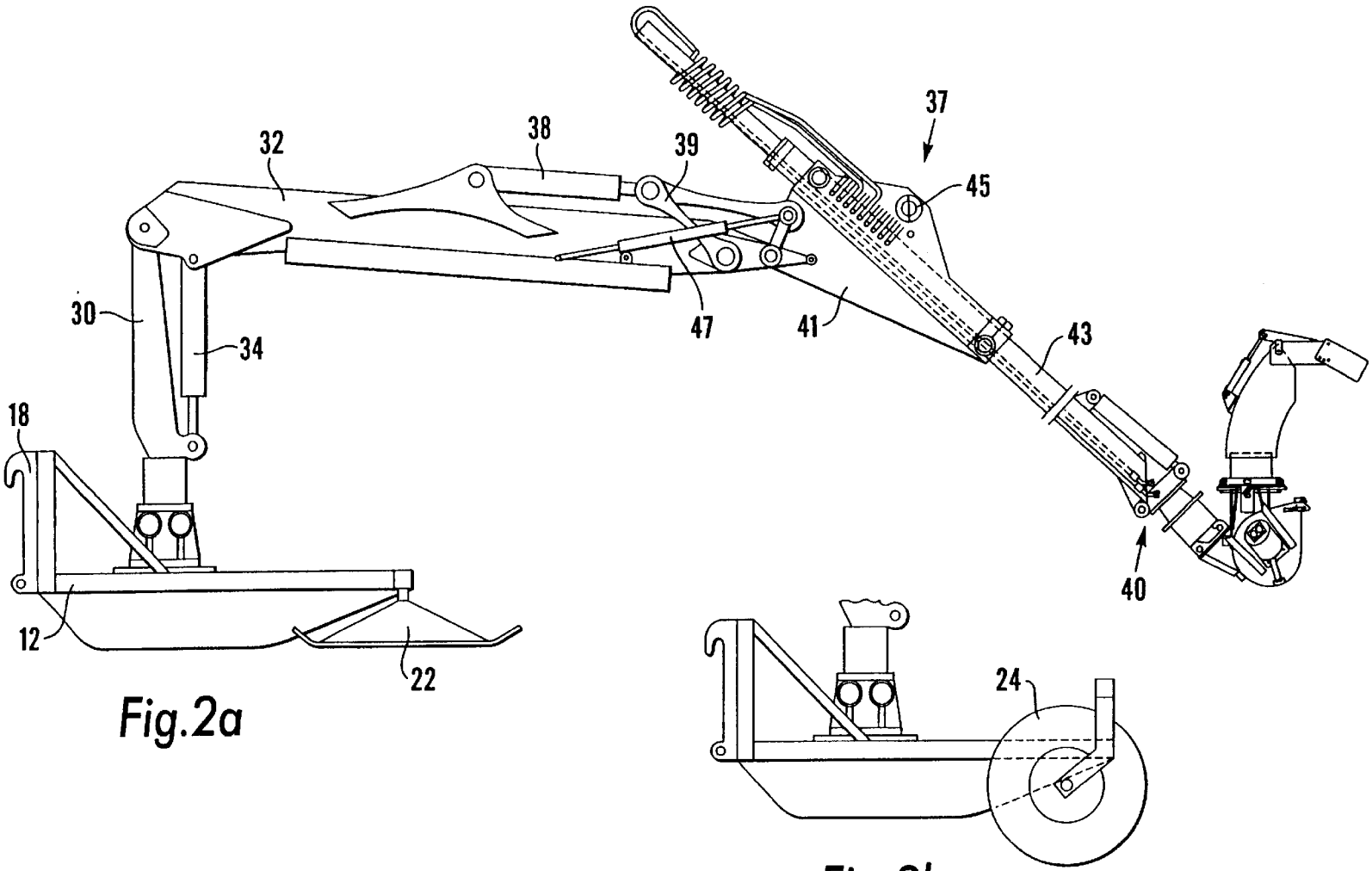
Figure 3:
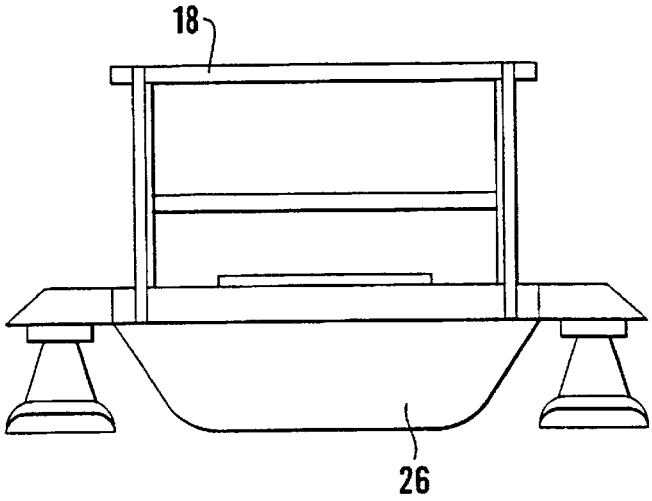
FIG. 3 shows a side view of the stand comprised in the device according to the invention.
Figure 4:
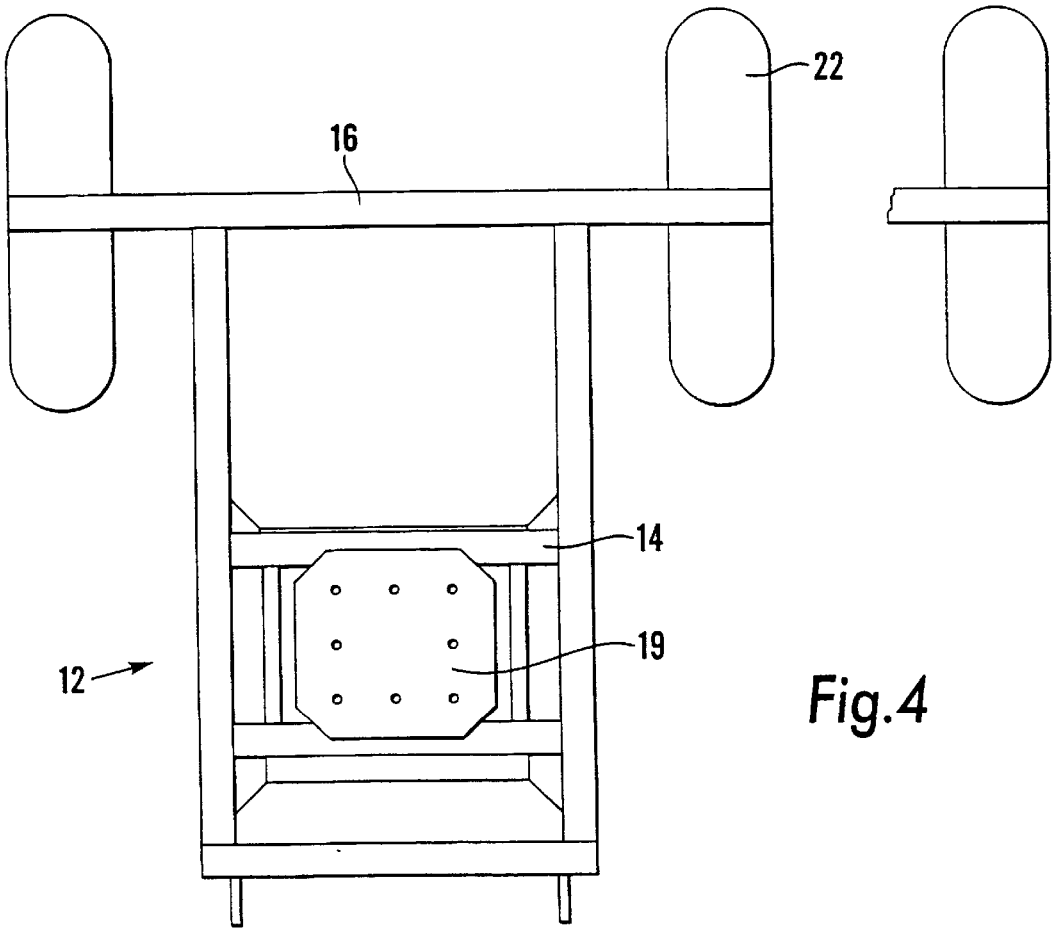
FIG. 4 shows a view from above of the stand according to FIG. 3.

On the front transversal beam 16 support members are arranged. In FIG. 2*a* these are in the form of skis 22 pivotably arranged to the ends of the transversal beam. In FIG. 2*b*, the skis are replaced by wheels 24, which are freely rotatable around a vertical axis. Preferably the length of the transversal beam can be changed by for example telescopically arranged tubes, FIG. 4, whereby the width of the device can be altered. This is an advantage for example if increased stability is desired. On the frame a trough-formed plate 26 is attached which provides a support surface, together with the support members, for the device. The trough-form with a rounding between the sides and bottom permits that the device also can be moved sideways, for example when a machine is turning, without too much resistance. The skis preferably also have a certain bowl-shape in the transversal direction for this reason. The design of the stand as a whole provides a very low centre of gravity of the device.

On the mounting plate 19 of the stand, a pillar 30 is rotatably attached. A hydraulic motor (not shown) is attached to the pillar for the turning of this. To the upper end of the pillar a boom 32 is pivotably arranged. At the outer end of the boom 32 a second boom 37, hereafter named outreach, is jointly arranged, FIG. 1. Between the boom and the outreach a hydraulic cylinder 38 is arranged, which, via a joint device 39, which permits a transmission of the power from the hydraulic cylinder, acts on the outreach. The outreach is designed with a support part 41 with a longitudinal compartment. In this compartment an arm 43 is slidably arranged for forward and reverse movement. A hydraulic motor 45 provides the movement of the arm via a chain transmission (not shown).

Figure 5:
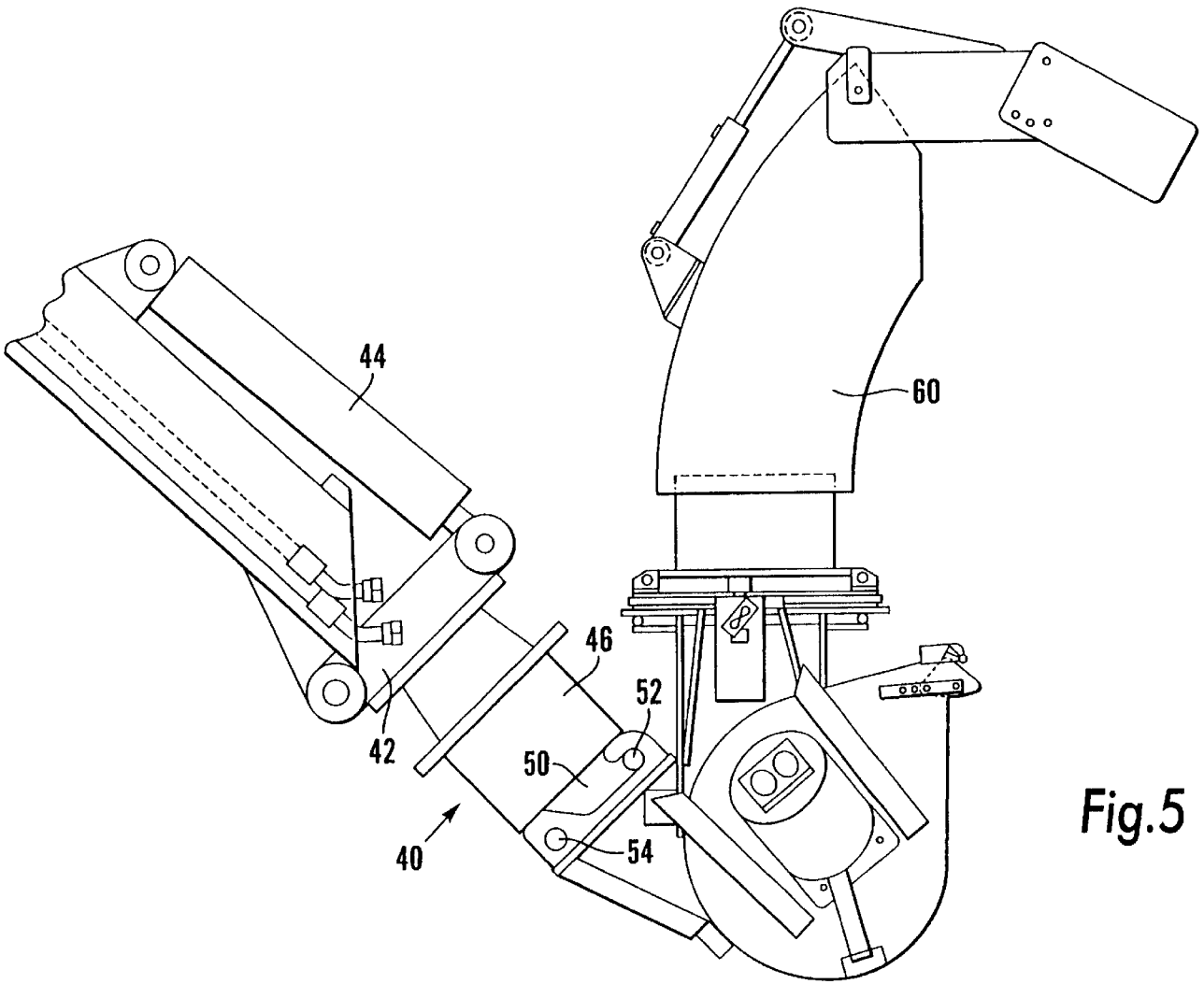
FIG. 5 shows a detailed view of the attachment between a snow working unit and a manoeuvring means according to the present invention.
Figure 6:
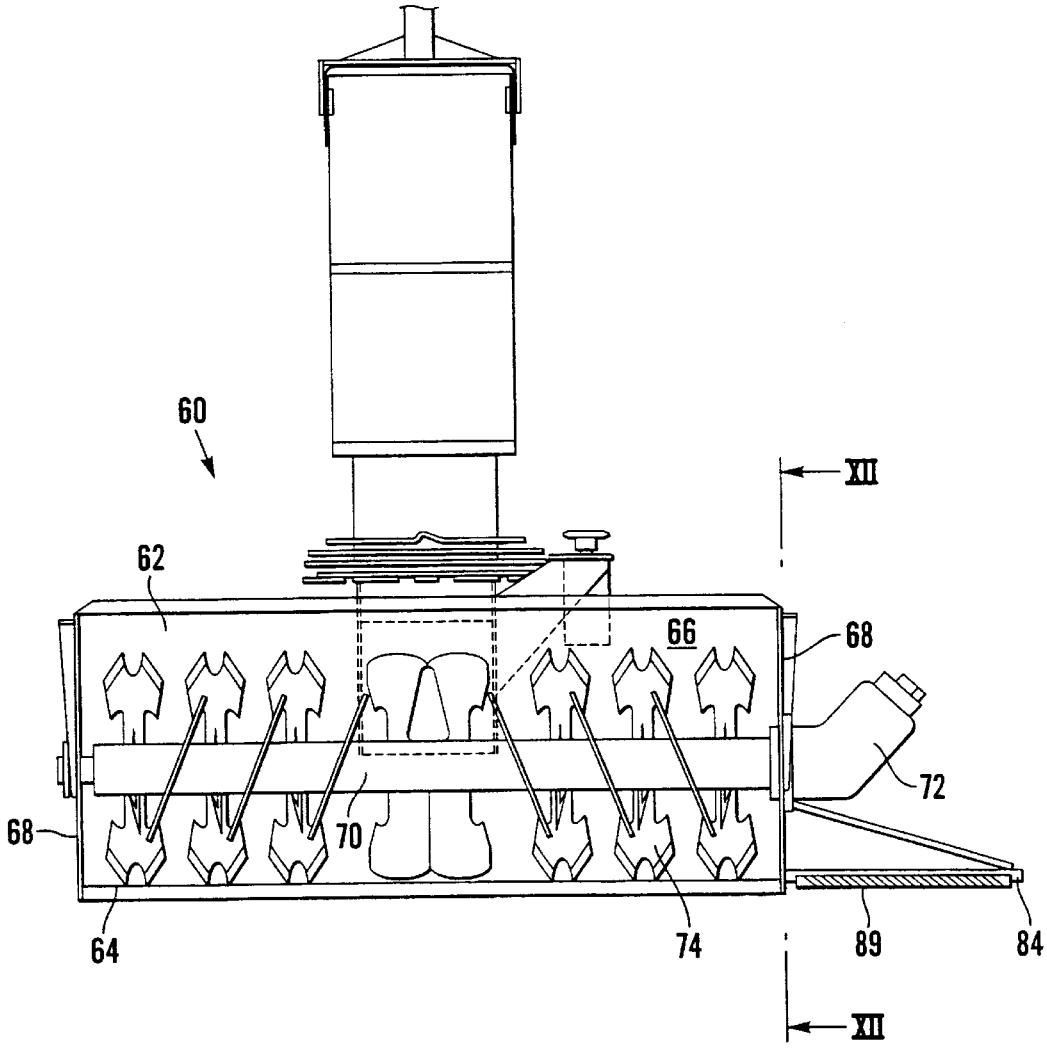
FIG. 6 shows a plan view of an embodiment of a snow working unit comprised in the present invention.
Figure 7:
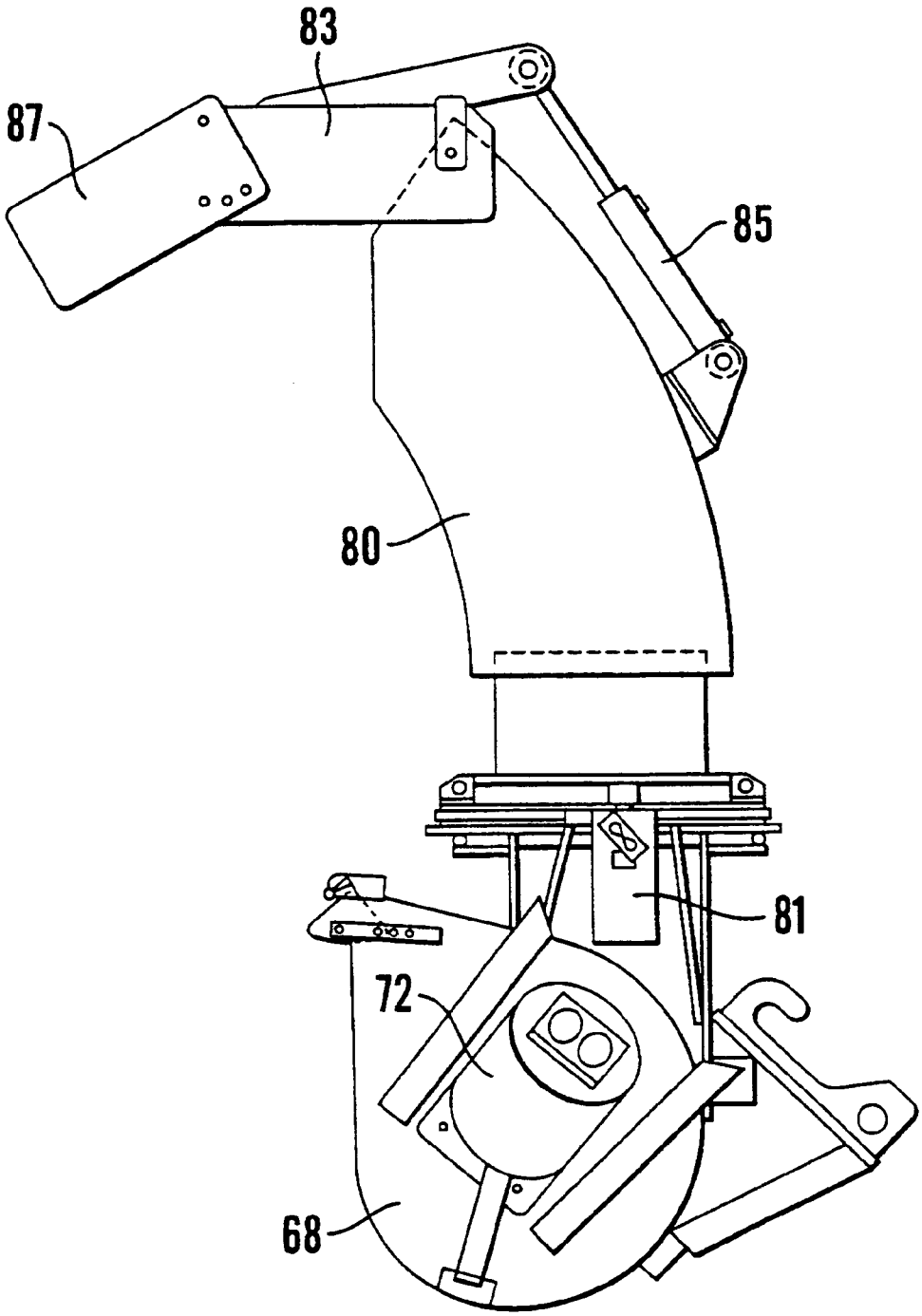
FIG. 7 shows a side view of the working unit according to FIG. 6.
Figure 8:
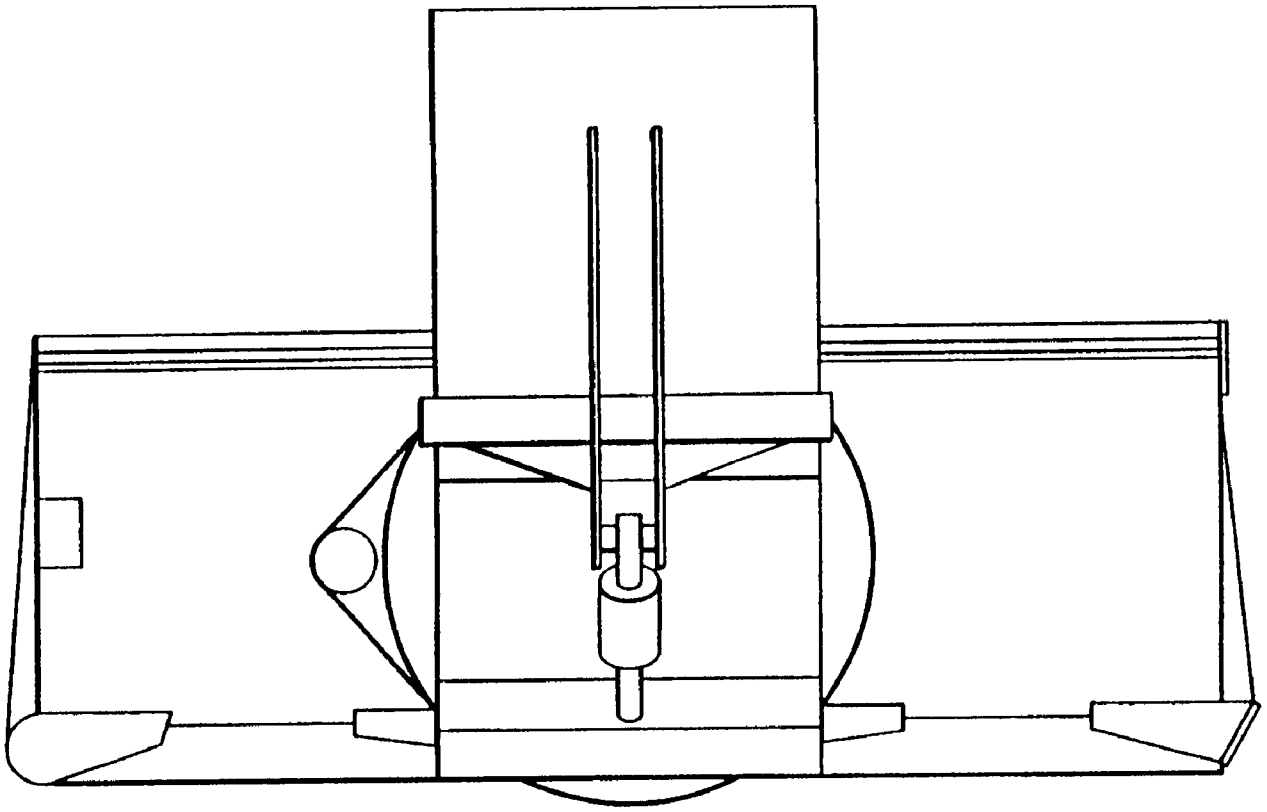
FIG. 8 shows a view from above of the working unit according to FIG. 6.

In the outer end of the arm a guide member 40 is arranged, FIG. 5. The guide member comprises an attachment plate 42 pivotably attached to the arm. A hydraulic cylinder 44 is arranged between the attachment plate 42 and the arm 40. To the attachment plate 42 a rotation attachment 46 is attached. The rotation attachment comprises a hydraulic motor (not shown) connected to the hydraulic system of the device. To the rotation attachment a first connection plate 50 is arranged, which displays locking bolts 52. The locking bolts are intended to fit into corresponding recesses in a second connection plate 54 attached to a working unit 60. When the locking bolts have been inserted in the second connection plate, both connection plates are locked with hydraulically driven locking pistons (not shown). The hydraulic conduits to the guide member are in the embodiment shown led inside the arm and out to its rear end and further to the vehicle, which provides that the conduits are being protected in the vicinity of the working tool and thereby reduces the risk of damages to these during work.

Figure 9:
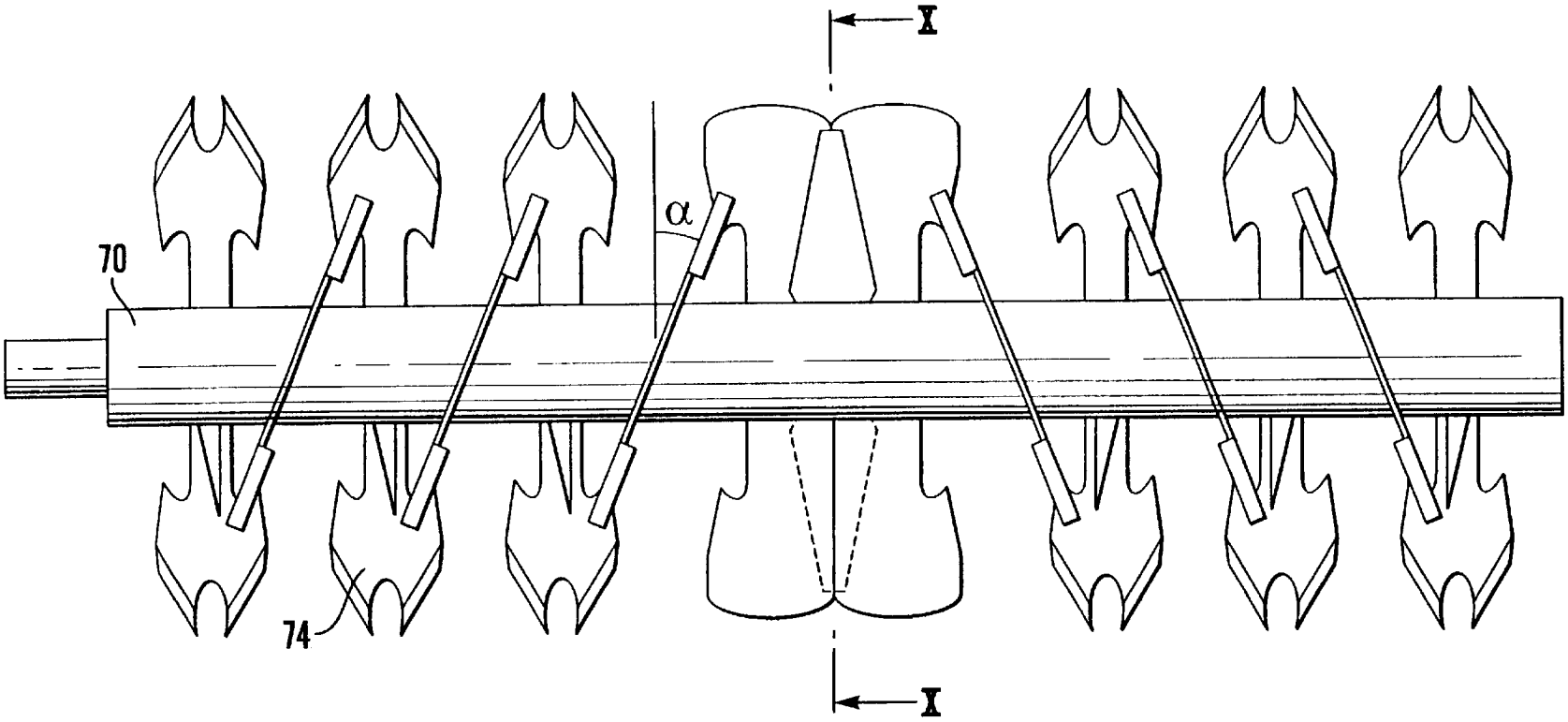
FIG. 9 shows a side view of a rotor comprised in the working unit according to FIG. 6.
Figure 10:
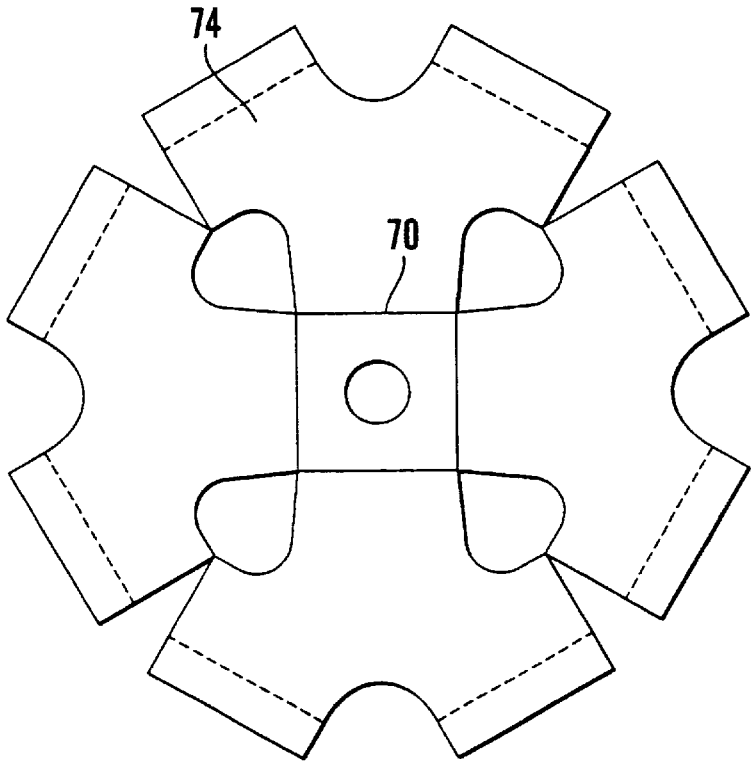
FIG. 10 shows a cross-section taken along the line X—X- of FIG. 9.
Figure 11:
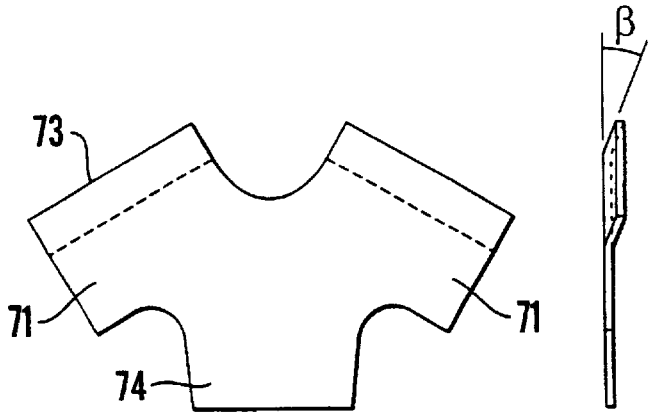
FIG. 11 shows a detailed view of a tooth comprised in the rotor of FIG. 9.

FIGS. 6–12 show an embodiment of a snow working unit 60 according to the invention. It comprises a shovel-looking housing 62 with a lower opening edge 64, a cutting edge. In the interior 66 of the casing, hereafter named milling box, and to its end plates 68, a shaft 70 is rotatably arranged with bearings. A hydraulic motor 72 is connected to the shaft. A number of plates 74, so called teeth, FIG. 10, are attached to the shaft and positioned such that a spiral pattern is obtained towards the centre of the shaft, FIG. 9. The teeth are designed with two "wings" 71, the outer edges 73 of which are bent with a certain angle and forward as seen in the direction of rotation.

In one design tested with good results, the teeth are arranged on the shaft with an angle $\alpha$, FIG. 9, of about 20° in relation to transversal direction of the shaft and with an inclination $\beta$ of the outer edges 73 of the teeth of about 20° in relation to the extension.

Figure 12:
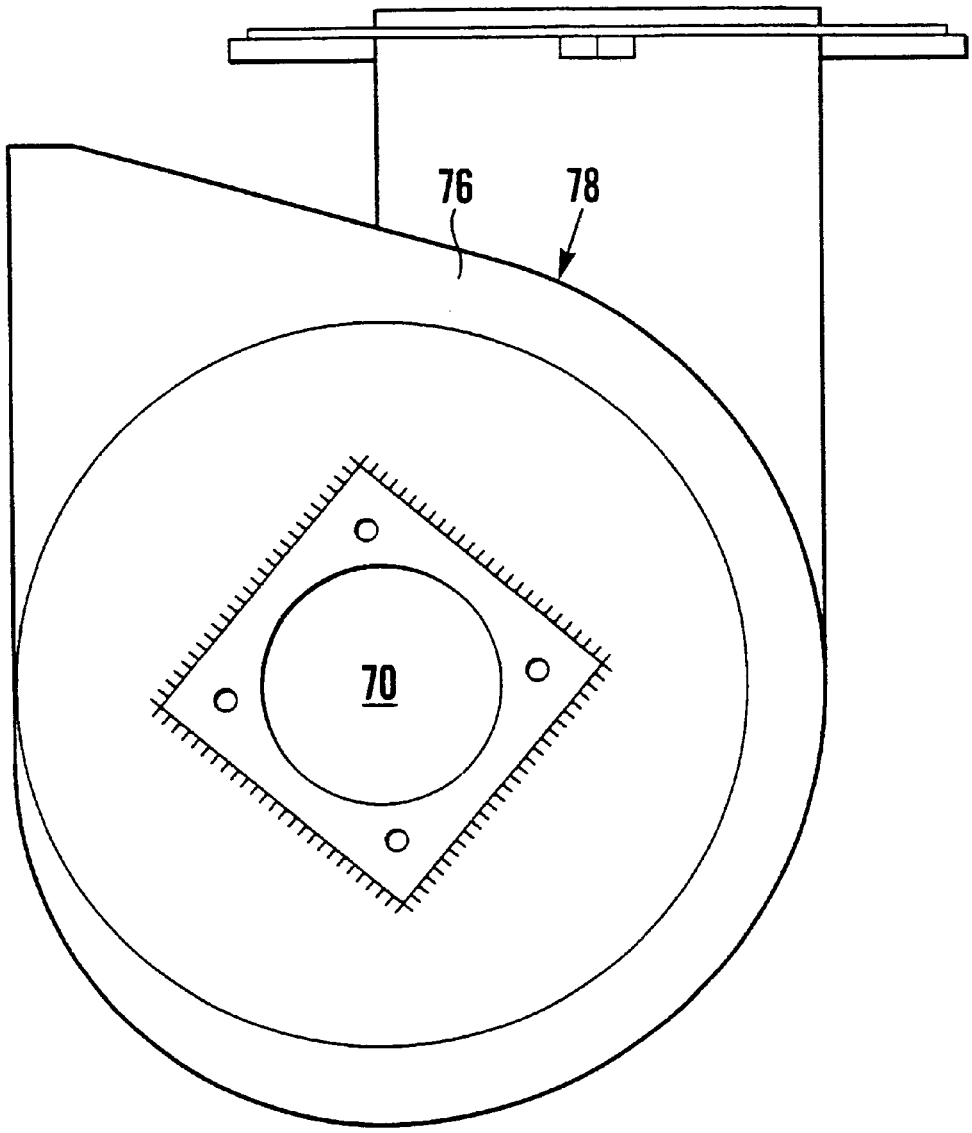
FIG. 12 shows a cross-sectional view taken along line XII—XII of FIG. 6.

The design of the milling box as seen in cross-section, FIG. 12, in relation to the shaft and its teeth is such that the distance, the clearing 76, between them increases successively forward in FIG. 12. In the upper part of the milling box an opening 78 is arranged, to which a discharge pipe 80 connects. The discharge pipe is arranged rotatable 360° with the aid of a hydraulic motor 81. This motor may be connected to a hydraulic cylinder 47, FIG. 2*a*, which is positioned between the arm and the outreach and connected such that the discharge pipe turns when the outreach moves upwards, i e an outward movement, and turns back when the outreach moves downwards. This function provides a possibility for automatically controlling the direction of the discharged snow, which is of value in particular when the working unit is working on higher vertical heights, such as the higher parts of a half-pipe. The upper part of the discharge pipe is arranged with a first guide plate 83 pivatbly attached to the discharge pipe and pivotable with the aid of a hydraulic cylinder 85. To the end of the first guide plate, a second guide plate 87 is arranged. The guide plates aid in guiding the discharged snow. An arm 84 is arranged on the side, preferably under the hydraulic motor, on which a so called finish mat 89 of rubber or plastic is attached, which finish mat evens the previously worked area.

In order to further facilitate the work and obtain an even form, it is conceivable to mount a rotatable mat, for instance a snowmobile mat, on a boggy with wheels and hydraulic drive, where this is liftable hydraulically. The intention with this is that one works on a first section to the desired radius with the mat raised. After that one moves to the next section whereby the mat is lowered and then is in contact with the previously worked section. The mat will thus ensure that the working of the later section will follow the previous section, which provides a smother form and that the level differences are avoided. Further, the drive of the mat aids in facilitating the drive of the working unit during work. Preferably the drive of the mat is affected by an adjustable valve, which acts so that the pulling capacity is limited so that the mat never skips. Further the drive of the mat may be designed such that it stops in the raised position and starts when it is lowered.

Figure 13:
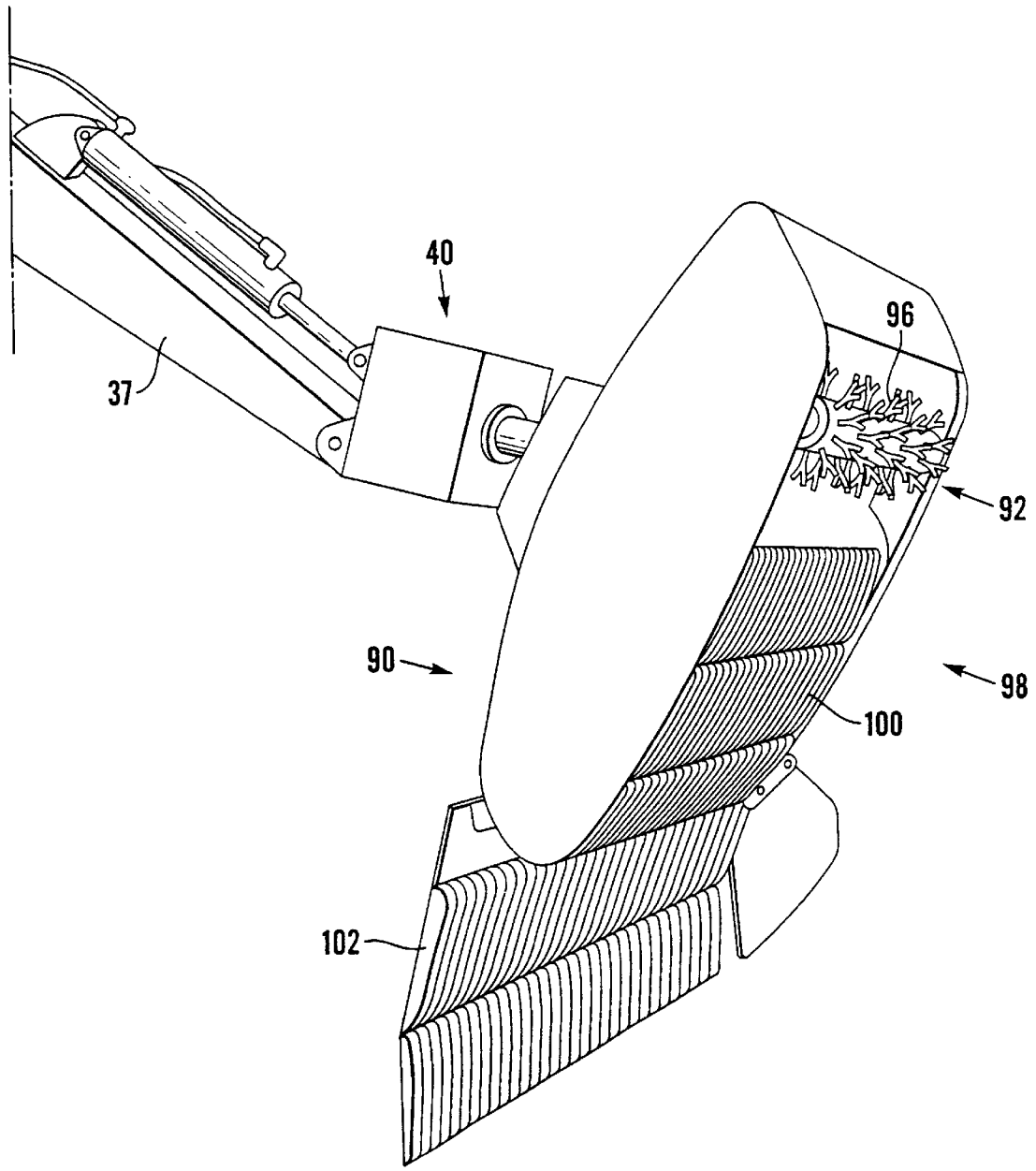
FIG. 13 shows a detailed view in perspective of a second embodiment of a snow working unit.
Figure 14:
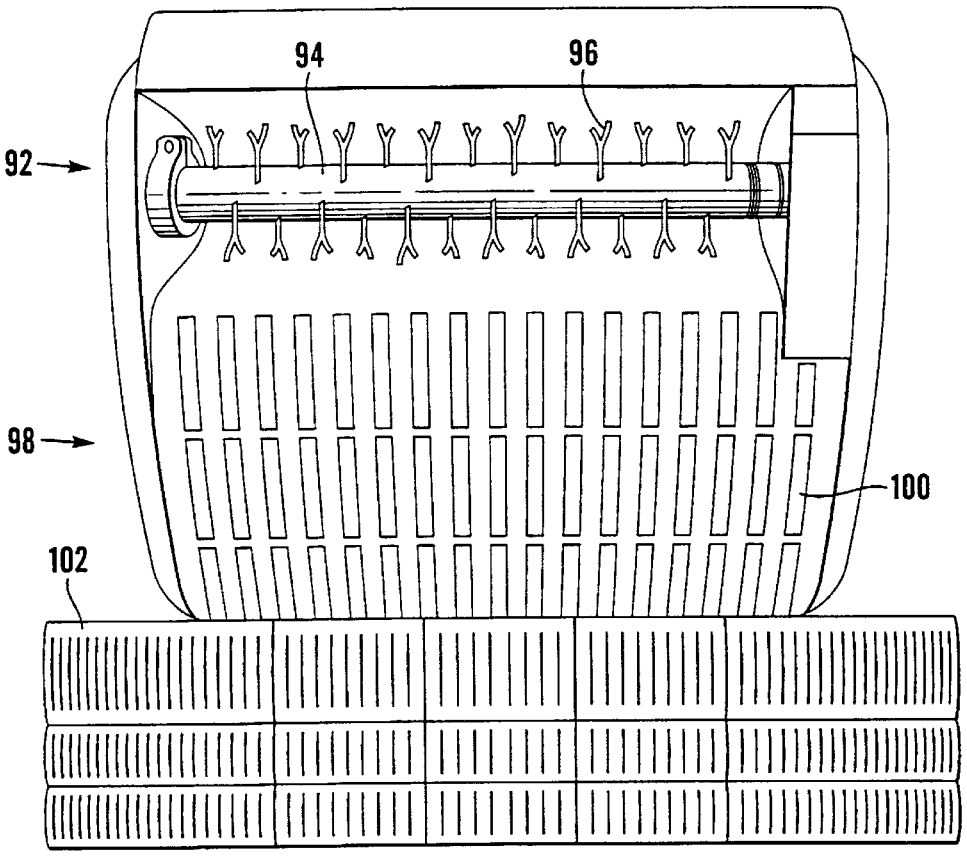
FIG. 14 shows a view from below of the snow working unit according to FIG. 13.

FIGS. 13 and 14 show a second embodiment of a snow working unit 90. In the front part 92 of the working unit a shaft 94 is rotatably arranged in a space open downwards. The shaft is directly connected to a hydraulic motor (not shown). The shaft is further arranged with radially protruding teeth 96. After the milling part a somewhat convexly shaped part 98 is arranged, which is formed with a number of ribs 100. At the rear edge of the snow working unit a profiled plate 102 is arranged. A hydraulically driven vibration device (not shown) is arranged in the working unit and capable of vibrating the same.

The function is as follows. The device is connected to the tool attachment of a vehicle, for example a snowgrooming vehicle. The hydraulic conduits of the device are connected to the hydraulic system of the snowgrooming vehicle whereby it does not require a hydraulic source of its own.

During use the hydraulic cylinders of the device are manoeuvred in order to turn the pillar 30 and turn the boom 32 and the outreach 37. The guide member 40 at the end of the outreach, FIG. 5, permits a turning of the working unit around the axis 48 by its hydraulic motor and tiliting of the working unit with the help of the rotation attachment 42 and the hydraulic cylinder 44 The hydraulic motor 45 on the outreach permits in and outgoing movement, i e shortening and extension of the length of the outreach.

In all a large spectrum of movement and working area is obtained for the working unit due to the design of the device, where the work area comprises substantially half a sphere.

Figure 15:
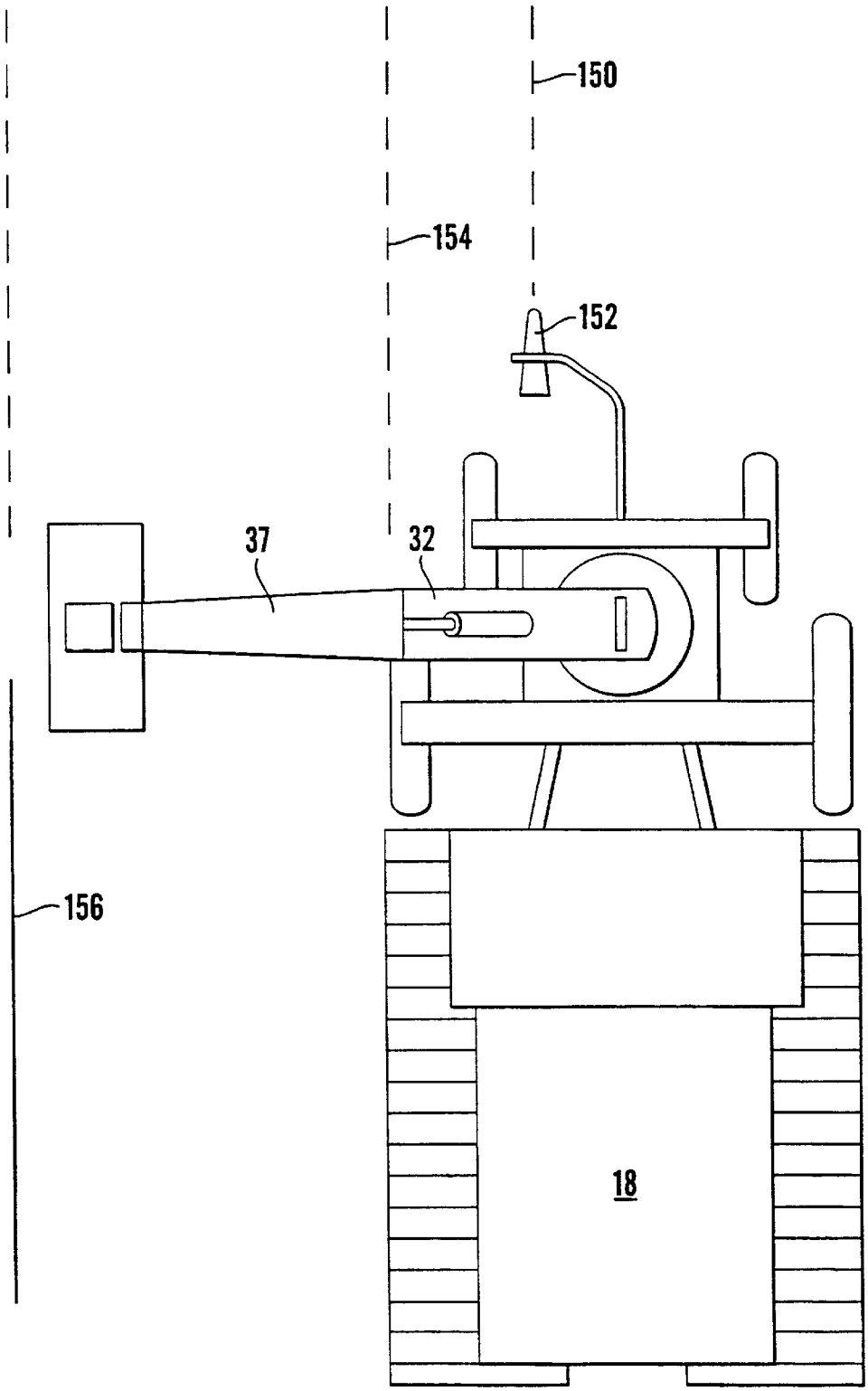
FIG. 15 shows the use of the device for producing a half-pipe.

FIG. 15 shows schematically the preparation of one of the walls of a half-pipe or a quarter-pipe. The snowgrooming vehicle 18 is placed along a marked line 150 in the longitudinal direction of the half-pipe to be formed. The device may be provided with aiming means such as for example a ski 152 so that the driver easily can follow the line. The boom 32 and the outreach 37 are directed transverse the longitudinal direction. For that an indicator may be arranged between the pillar 30 and the stand 12 in order to indicate the rotational angle of the pillar in relation to the stand. A libel can be arranged in the driver's cab so that the driver can judge the horizontal position of the machine. The boom is then manoeuvred to a certain angular position in relation to the pillar.

Because the length of the boom and the outreach are known it can be obtained between which angles the boom must be when the outreach is swung out and the length the outreach shall have. The snow working unit works from the machine and outwards by turning the boom whereby the snow working unit is moved along a curved path, FIG. 1, with a certain determined radius from the bottom of the half-pipe 154, FIG. 9, to the edge of the half-pipe 156. The design of the device enables the work with different radii from about 1,5 m to 6,8 m, depending on requirement, completely variable, and different angles and inclinations.

Due to the design of the discharge pipe the worked snow is moved in front and upwards from the snow working unit and builds in that way up the walls.

When the snow working unit works in the curved part and up against the vertical part of the half-pipe, the working unit is tilted upwards with the help of the guide attachment 40. The driver thereby also has possibilities to rotate the snow working unit around the axis 48 if the form of the snow surface so demands. The driver also has possibilities to control the direction of the discharged snow by turning the discharge pipe 80. In this manner very varied and exactly formed snow surfaces can be easily and flexibly created.

The design of the snow working unit 60 provides distinct advantages. Due to the placement of the teeth 74 on the shaft 70 so that a spiral shaped pattern is obtained the worked snow is efficiently moved in against the opening 78 and out through the discharge pipe 80. The design of the snow working unit means that one in the same movement obtains a snow miller and snow thrower, cutting means due to the cutting edge on the working unit and a finish with the finish mat. The design of the cutting box with the clearance gives that a "curtain" of snow is formed in front of the working unit that fills eventual holes and the like, at the same time as the clearance also assures that worked snow is led away out through the discharge pipe. In total it provides a very controlled handling of the snow without the risk for falling snow on worked sections and without the risk for the creation of "snow clouds" around the working unit.

In order to obtain an even and in particular durable snow surface and in order to recondition for example a half-pipe after a day's riding, the snow working unit 90 according to FIGS. 13 and 14 is utilised. This working unit is controlled in the same way as the previously described working unit. During use the milling device 92 provides a grinding of the snow surface and a mix of cold air in order to increase the freezing layer of the surface layer of the snow. The profiled part 98 together with the vibration of the working unit provides a vibration and packing of the worked snow surface. Finally the worked and vibrated surface is formed with the help of the profiled plate 102.

The device according to the invention is intended firstly to be manoeuvred from the driver's cab of the snowgrooming vehicle. Preferably the device is also provided with a cordless remote manoeuvring equipment so that the operator can stand in the vicinity of the snow working unit for certain operations in order to obtain a better overview over the work.

The system can also be provided with a highly sensitive detector, for example an infra red detector, which detects the radiation from a person or other living being moving within the detection area. The IR-detector can be connected to warning lights or sound or the motor of the snow working unit or the whole device, which then stops if a person is detected within the area.

In a further development of the system it is conceivable to also connect equipment for GPS navigation. Most ski resorts have electronic maps over the area, in which it is possible to enter three-dimensional ski run profiles with coordinates for the position of the ski run profile, whereby signals from a base-station and the GPS-receiver controls the device according to a pre-programmed ski run profile.

Even if the described snow working units are arranged with rotating snow milling/snow throwing devices, it is very conceivable to use other devices for making the device flexible and useful. These devices comprise work platforms, bush and grass cutting units for preparing ski runs at summer time, gripping claws for loading and de-loading of for example water pipes for snow guns, removal of fallen trees and the like, crane hooks, shovels and the like devices. These possibilities provides for the device according to the invention to be used for a number of different work tasks during winter as well as summer. The attachments makes it possible to use several different vehicles with the present invention.

It is to be understood that the invention as described above and shown in the drawings only is to be regarded as non-limiting examples of the present invention and that it is defined by the following patent claims.

What is claimed is:

1. Device (10) for performing work tasks within a work area, comprising:

a stand comprising contact and support means for supporting said stand when placed on a surface;

a maneuvering means movably attached to said stand;

a working unit arranged to said maneuvering means, wherein the maneuvering means is capable of maneuvering the working unit in at least three degrees of freedom; and attachment means arranged to said stand for detachably connecting said device to a tool attachment of a work vehicle.

2. Device according to claim 1, characterised in that it is hydraulically driven and maneuvered and attached to the hydraulic system of the work vehicle.

3. Device according to claim 1, characterised in that it is arranged in front of the work vehicle and in the view of the driver during movement of the vehicle.

4. Device according to claim 1, characterised in that the maneuvering means is capable of maneuvering the working unit within a work area comprising substantially half a sphere.

5. Device according to claim 1, characterised in that the working unit is arranged such that the maneuvering means is maneuverable in at least one degree of freedom.

6. Device according to claim 1, characterised in that the maneuvering means comprises a substantially vertical first arm (30), hereafter named pillar, rotatably arranged around a turning axis substantially coinciding with a longitudinal axis, and at least a second arm (32), hereafter named boom, rotatably arranged with one end to the pillar around a turning point arranged substantially perpendicular to the turning axis of the pillar, and a third arm (37), hereafter named outreach, rotatably arranged to the other end of the boom around a turning point arranged substantially horizontal and perpendicular to the longitudinal directions of the boom and the outreach.

7. Device according to claim 6, characterised in that a guide means (40) is rotatably arranged to a free end of the outreach and perpendicular to the longitudinal direction of the outreach, and in that the guide means is arranged with an attachment member (50, 52) by which a working unit can be detachably attached.

8. Device according to claim 7, characterised in that the guide means comprises a hydraulically maneuverable rotatable shaft (48) to which the attachment member is attached.

9. Device according to claim 1, further comprising control means (34, 36, 38, 44) capable of controlling the movements of the device so that the working unit follows a predetermined work path.

10. The device of claim 1 on a snow working unit, characterised in that the device comprises a housing with an opening, that a lower edge of the opening is designed as a cutting edge, a rotating shaft arranged in the housing, a number of teeth arranged on the shaft for machining snow, whereby the teeth are attached to the shaft such that they form a spiral pattern running from both ends of the shaft towards its centre.

11. Device according to claim 10, characterised in that the distance between the teeth on the shaft and the inner walls of a housing increases towards an upper edge of the opening.

12. Device according to claim 10, characterised in that cutting edges of the teeth are angled in relation to their propagation.

13. Device according claim 10, further comprising a directable discharge pipe.

14. The device of claim 1 on a snow working unit, characterised in that the device comprises a milling device (92) for milling the snow surface and a following packing part (98) comprising a substantially planar surface.

15. Device according to claim 14, characterised in that the packing part is arranged with a plurality of ribs extending in a work direction.

16. Device according to claim 14, further comprising a vibrating means for packing of the milled snow surface.

17. Device according to claim 14, characterised in that the packing part has a somewhat convex form seen in the work direction of the snow working unit.

18. Device according to claim 14, further comprising, after the packing part as seen in the work direction, a profiled plate (102) for final adjustment of the snow surface.

19. The device of claim 1, characterised in that the device is adapted for a ski run area.

* * * * *